US007412731B1

(12) United States Patent
Brassill

(10) Patent No.: US 7,412,731 B1
(45) Date of Patent: Aug. 19, 2008

(54) ATHLETIC PROTECTIVE UNDERGARMENT

(76) Inventor: Patrick Brassill, 2021 Booksin Ave., San Jose, CA (US) 95125

( * ) Notice: Subject to any disclaimer, the term of this patent is extended or adjusted under 35 U.S.C. 154(b) by 0 days.

(21) Appl. No.: 11/701,932

(22) Filed: Feb. 2, 2007

(51) Int. Cl.
*A41D 13/12* (2006.01)

(52) U.S. Cl. ..... 2/456; 2/23

(58) Field of Classification Search ..... 2/466, 2/267, 2, 228, 227, 455, 456, 69, 23, 24, 2/79, 911
See application file for complete search history.

(56) References Cited

U.S. PATENT DOCUMENTS

| | | | | |
|---|---|---|---|---|
| 4,397,636 | A * | 8/1983 | Ganshaw | 441/65 |
| 5,060,313 | A | 10/1991 | Neuhalfen | 2/2 |
| 5,471,906 | A * | 12/1995 | Bachner et al. | 89/36.05 |
| 5,551,082 | A * | 9/1996 | Stewart et al. | 2/465 |
| 5,689,836 | A * | 11/1997 | Fee et al. | 2/465 |
| 6,295,654 | B1 | 10/2001 | Farrell | 2/456 |
| 6,532,599 | B1 * | 3/2003 | Dugan | 2/228 |
| 7,082,621 | B1 * | 8/2006 | Fratesi | 2/227 |
| 2004/0078873 | A1 * | 4/2004 | Goodwin | 2/267 |
| 2004/0158913 | A1 * | 8/2004 | Goodwin | 2/267 |
| 2005/0081277 | A1 * | 4/2005 | Matechen et al. | 2/102 |
| 2006/0026732 | A1 * | 2/2006 | Nordt et al. | 2/69 |
| 2006/0179545 | A1 * | 8/2006 | Arensdorf et al. | 2/227 |
| 2006/0191052 | A1 * | 8/2006 | Bulian | 2/23 |
| 2006/0272071 | A1 * | 12/2006 | Mickle | 2/69 |

* cited by examiner

*Primary Examiner*—Katherine Moran
*Assistant Examiner*—Richale L Quinn
(74) *Attorney, Agent, or Firm*—Law Offices of Terry McHugh

(57) ABSTRACT

A protective undergarment, such as trousers or a shirt intended for use under other clothing, employs seamless welding to permanently affix one or more protective pad segments to the main body of material. An ultra-sonic welding process may be employed. Thus, a welding material, such as a suitable polymeric film, may be used to fuse a small-area fabric member to the main body material of the undergarment, so as to form a pocket for a pad segment. To ensure that the pad segment does not fold or otherwise move within the pocket, at least one channel may be formed within the pad segment to allow welding within the interior of the pad segment.

14 Claims, 7 Drawing Sheets

ATHLETIC PROTECTIVE UNDERGARMENT

TECHNICAL FIELD

The invention relates generally to protective padded undergarments. More particularly, the invention relates to an undergarment constructed of thin, stretchable fabric with protective foam components that can be worn under the outer clothing worn by participants in physical activities.

BACKGROUND OF THE INVENTION

A range of factors must be considered in the construction of protective padded undergarments worn during participation in physical activities, such as contact sports. In particular, the factors include the comfort, the flexibility and the evaporative cooling enabled by the protective padded undergarments.

The conventional protective padded undergarment is an assembly composed of a fabric undergarment with one or more padded foam assemblies in which soft pad components are permanently attached to the fabric undergarment by sewing and/or adhesives.

A padded foam assembly of the conventional protective padded undergarment is typically a lamination comprised of a pad component, such as foam, and a fabric overlayer component. Typically, the foam component is affixed to the fabric overlayer using an adhesive. However, by fixing the fabric overlayer component to the pad component of the assembly using adhesive, the flexibility of the assembly is limited to the properties of the least flexible portion of the assembly.

Moreover, by laminating the fabric overlayer of the padded foam assembly to the foam component of the assembly by means of adhesive, there are limitations on the ability of the assembly to allow the flow of body heat and moisture generated by the wearer. These limitations are significant if "webbing type" film adhesive is used, but are even more objectionable if non "webbing type" adhesive is applied to at least one of the components.

In the conventional protective padded undergarment, the padded foam assembly is permanently attached to the fabric undergarment by stitching the perimeter of the assembly to the adjacent surface of the fabric undergarment. The flexibility properties of the thread-and-stitch design limits the stretching properties of the conventional protective padded undergarment, since the flexibility of the fabric area encompassed by the stitching is limited to the combined flexibility properties of the thread material and the particular stitch pattern.

Another concern with stitching the padding subassembly to the adjacent surface of the fabric undergarment is that it creates an abrasive raised thread surface on which the seam is exposed. This abrasive seam acts as a potential irritant to the skin of the wearer.

SUMMARY OF THE INVENTION

A protective undergarment in accordance with the invention achieves high levels of comfort, flexibility and material breathing by "welding" one or more protective pad segments to the main body of material, which defines the shape of the undergarment. In one embodiment, the under-garment has the shape of trousers and is designed to be worn between the body of the wearer and a pair of pants. In another embodiment, the main body of material has the shape of an undershirt. As used herein, the term "weld" refers to a connection that is threadless and that initially requires the application of heat.

The invention is further directed to the method of permanently attaching a protective pad segment to the main body of material of the undergarment. The main body is formed of a fabric which is air permeable and moisture wicking. Moreover, the material is capable of simultaneously stretching in orthogonal directions.

Each protective pad segment is trapped in position between the main body of material and a small-area fabric member. In the preferred embodiment, this fabric member is dimensioned to be larger than the protective pad segment, so as to enable the fabric member to directly contact the main body of material beyond the perimeter of the protective pad segment. This small-area fabric member should also be air permeable, moisture wicking, and capable of simultaneously stretching in orthogonal directions. The trapped protective pad segment is constructed of compressible, energy-absorbing material intended to provide protection for the wearer.

Each small-area fabric member is threadlessly welded, or "fused," to the main body of material. Thus, rather than a connection that potentially affects the comfort of the wearer as a result of exposed threaded seams, the welded coupling of components is likely to be tactically undetectable after the undergarment is covered by other clothing.

In another aspect, the present invention is directed to the use of an ultrasonic welding process. Whereas ultrasonic welding has been used for fusing non-stretching, non-moisture wicking polymeric materials to create moisture-proof seams, the present invention utilizes ultrasonic welding of polymeric materials which stretch in orthogonal directions and which contain micro fibers that provide permanent moisture wicking. The physical properties of the fabrics used in the present invention have a melting temperature (i.e., a temperature at which the material changes from its solid state to its liquid state) that is substantially higher than its softening temperature (i.e., the temperature at which the material becomes soft and sticky without losing shape and without damaging fiber structures. In addition, the softening temperature of the materials of the undergarment which are bonded using ultrasonic welding is substantially equal to the melting temperature of a flexible polymeric film which is added at the junction of the main body of material and the small-area fabric member or members. Upon the application of ultrasonic energy, the flexible polymeric film reaches its melting temperature and the materials being fused reach their softening temperature, so that the materials are permanently fused when the ultrasonic energy is removed. An advantage of the invention is that threadless bonding of the different components is achieved through ultrasonic welding, so as to avoid compromise of the strength or stretching properties of the components.

In another feature of the invention, the material that is added in order to enable a reliable welding of components has a flexibility that equals or exceeds the flexibility properties of the material or materials of the main body and the small-area fabric member. Thus, the resulting undergarment enables greater flexibility for the wearer than the conventional padded protective undergarment that employs threads and/or adhesives in the assembly process. In accordance with this feature of the invention, the flexible polymeric film used in the ultrasonic welding process of the preferred embodiment has a flexibility equal to or exceeding that of the other materials.

In another aspect of the invention, the protective pad segments are permanently positioned relative to the main body of material of the under-garment without the use of adhesives on any surface of the pad segments or any surface of adjacent fabric components in direct contact with the pad segments.

Thus, the protective undergarment provides improvements with respect to breathability and moisture management.

Particularly with larger protective pad segments, there may be a concern that the pad segment will fold or will rotate within the "pocket" formed between the main body of material and the small-area fabric member associated with the particular pad segment. This concern may be addressed by providing one or more channels through the pad segment and then extending the welding of fabrics so as to include the area within the channels. That is, in addition to welding along the perimeter of the pad segment, the welding extends within the channel or channels.

Another advantage of the invention is a result of use of fabrics that include micro fibers, which permanently enhance the transport of moisture away from the body of the wearer. That is, the material is moisture wicking. As used herein, "moisture wicking" fabric is defined as a fabric having fibers adapted to carry moisture outwardly away from contact with the skin of the wearer. The term "stretchable" is defined as the capability of extending or distending in response to a force or stress and then resuming substantially its original shape and dimensions immediately upon release of the force or stress.

DETAILED DESCRIPTION

With reference to FIGS. 1A, 1B, 2, 3 and 4, one embodiment of the invention is to provide a protective undergarment for use as trousers 10. Thus, the trousers may be worn beneath pants during sporting events, such as lacrosse. While the invention will be primarily described with reference to the trouser embodiment, the invention applies to forming shirts and other protective apparel to be worn beneath other clothing.

Figure 2:
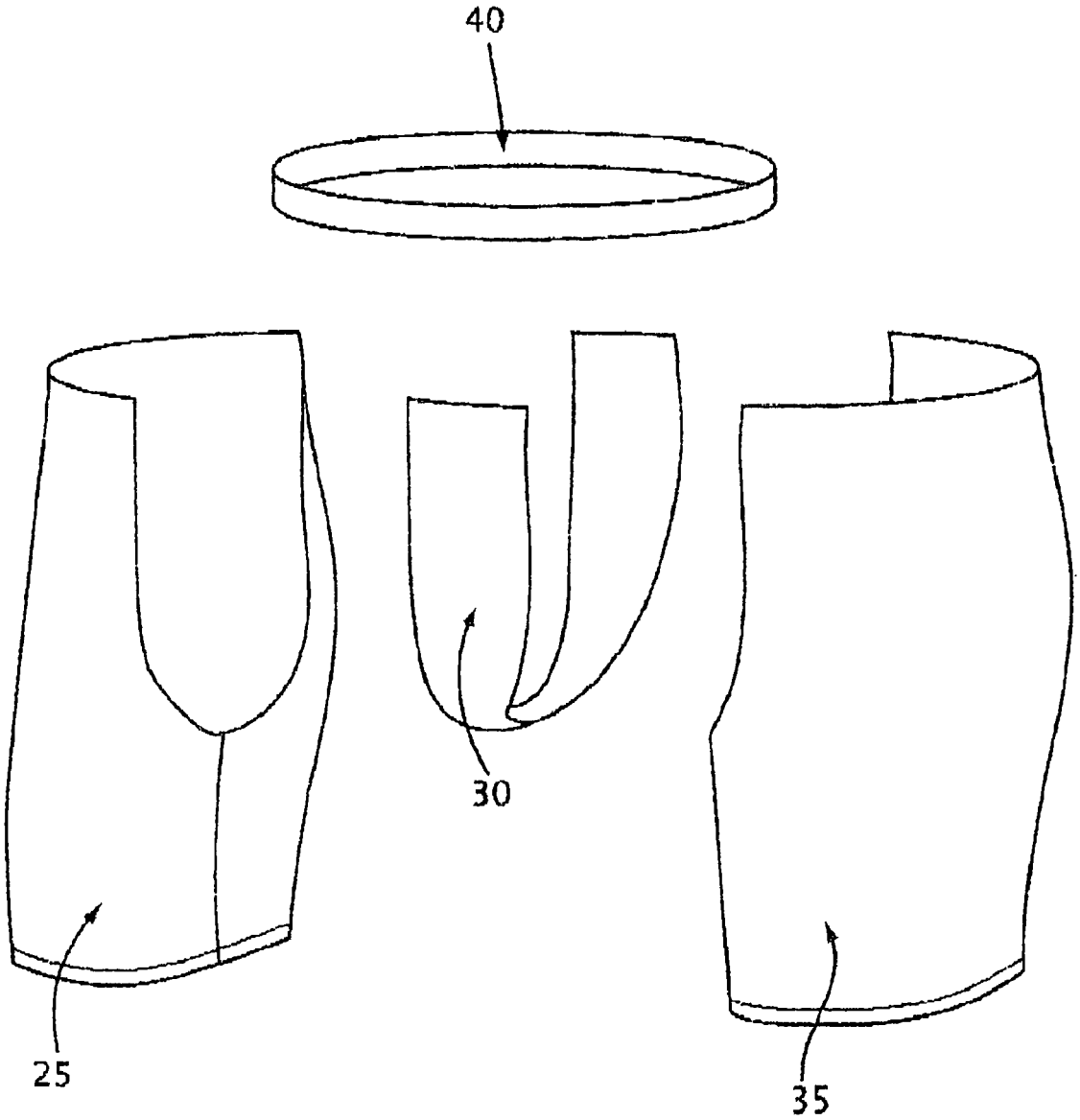
FIG. 2 is an exploded perspective view of the protective undergarment of FIGS. 1A and 1B.

As best viewed in FIG. 2, the main body of material for the trousers 10 includes a pair of legs 25 and 35 joined at a center panel 30. An elastic waistband 40 is attached to the tops of the legs and the center panel. The main body of material which defines the two legs and the center panel is formed of a moisture wicking fabric which includes synthetic micro fibers and elastic. Acceptable materials include spandex and lycra.

The protective undergarment 10 is shown as having three pad segments 45, 50 and 55 attached to the main body of material. In the illustrated embodiment, protective pad segment 45 is attached to leg 25, protective pad segment 50 is attached to the center panel 30, and protective pad segment 55 is attached to leg 35. The pad segments are preferably constructed of perforated compressible and energy absorbing material. Acceptable materials include PE (polyethylene) foam and EVA (ethyl vinyl acetate) foam.

Figure 4:
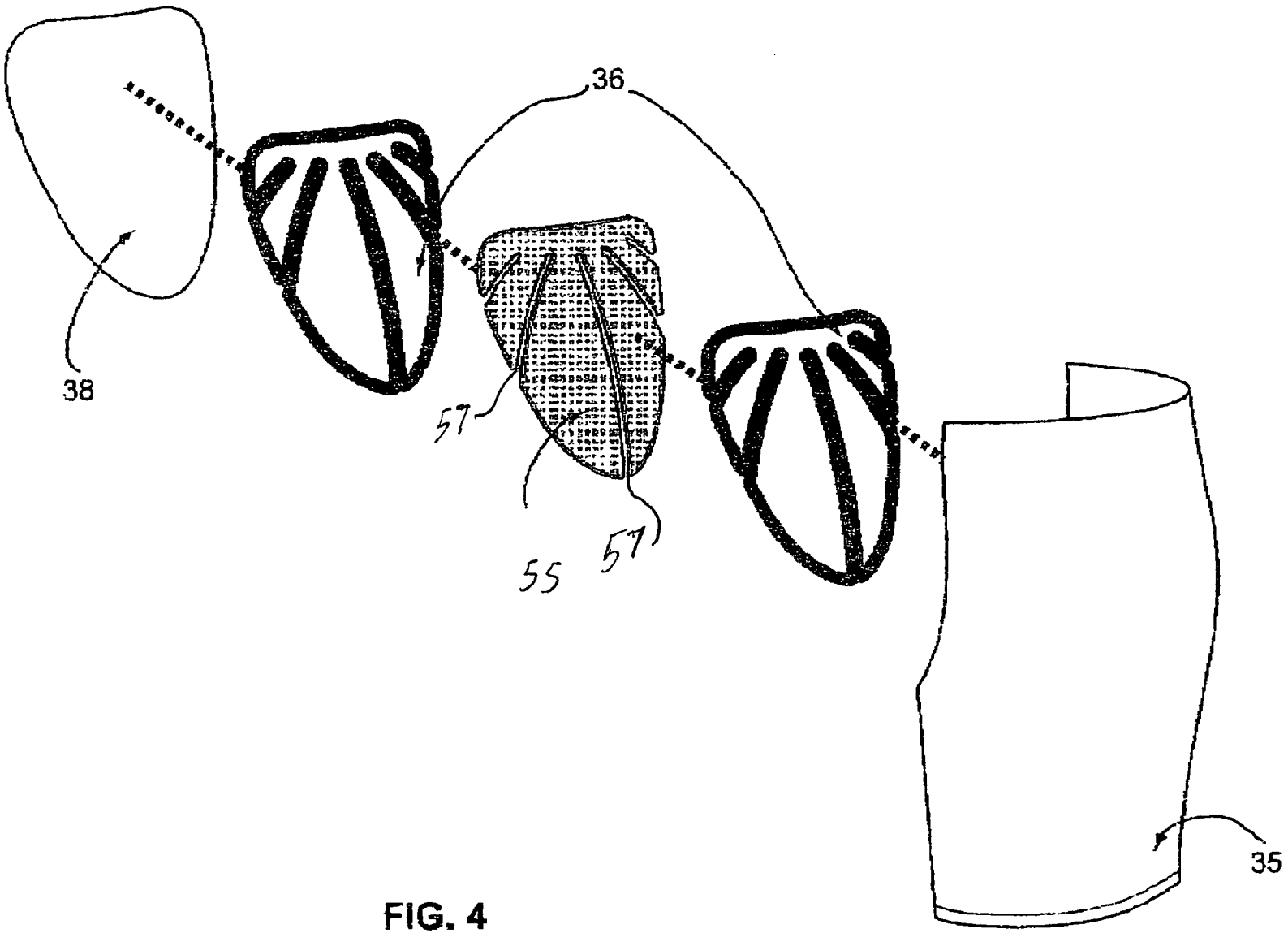
FIG. 4 is an exploded perspective view of components used to permanently position a protective pad segment to the main body of material of a protective undergarment in accordance with the invention.

The attachment of a protective pad segment to the main body of material is best illustrated in FIG. 4. A pair of die-cut polymeric film material units 36 are thermally attached to the leg 35 and a small-area fabric member 38 after the pad segment 55 is placed in the desired position. The welding of the small-area fabric member to the main body of material by means of the polymeric film welds the fabric components together. Preferably, the small-area fabric member 38 is formed of the same material as the leg 35. Ultrasonic welding has been identified as providing the desired results. In accordance with ultrasonic welding, the melting temperature of the material used to form the leg 35 and the small-area fabric member 38 is substantially higher than the softening temperature of the polymeric film 36. However, the softening temperature of the fabric is substantially equal to the melting temperature of the polymeric film. When ultrasonic energy is applied, the polymeric film reaches its melting temperature and the fabric reaches its softening temperature, causing the welding of the materials, so that they are permanently fused when the ultrasonic energy is removed.

Figure 1A:
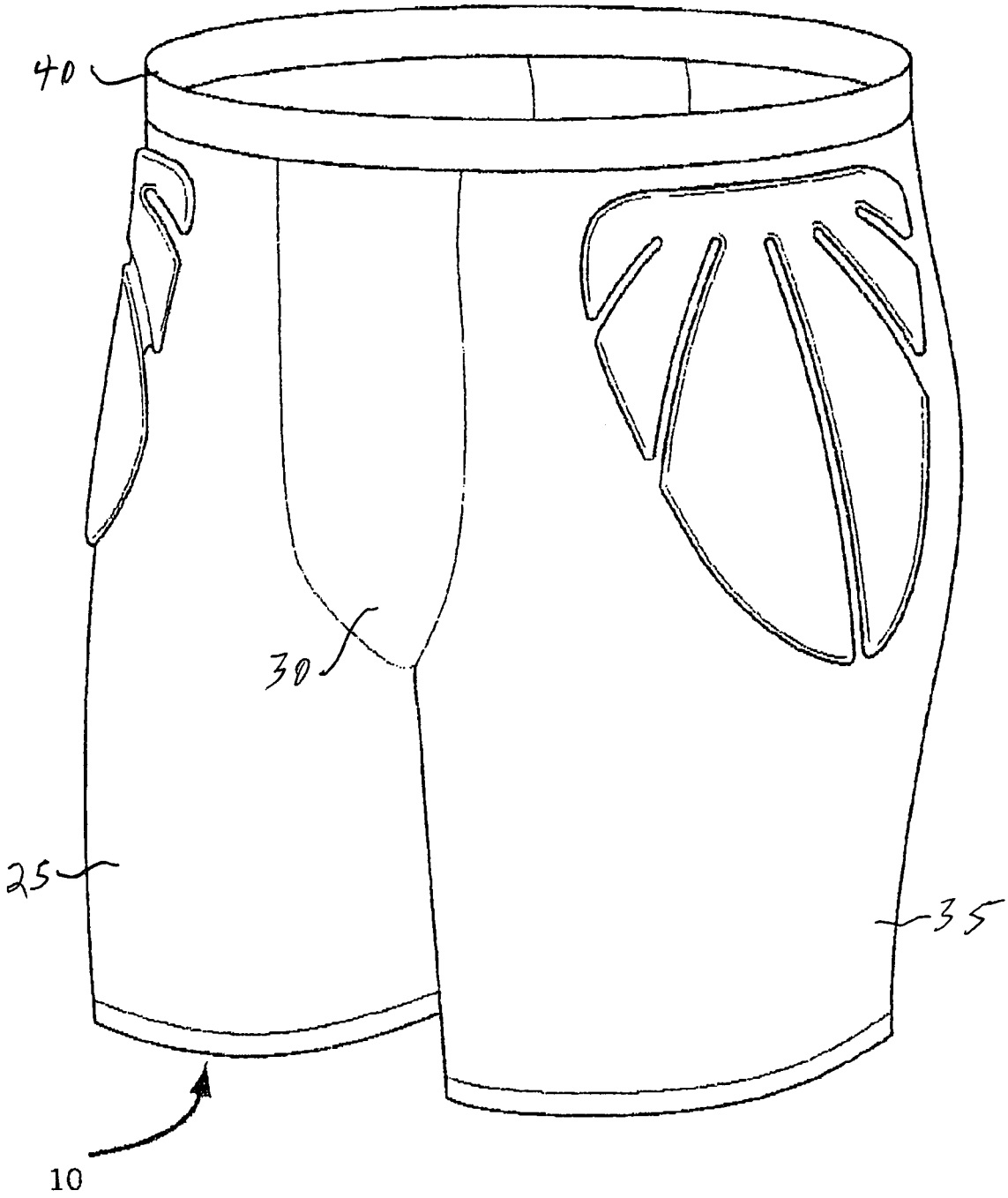
FIG. 1A is a front perspective view of a protective undergarment in accordance with am embodiment of the invention in which the undergarment is to be worn as trousers beneath other clothing.
Figure 1B:
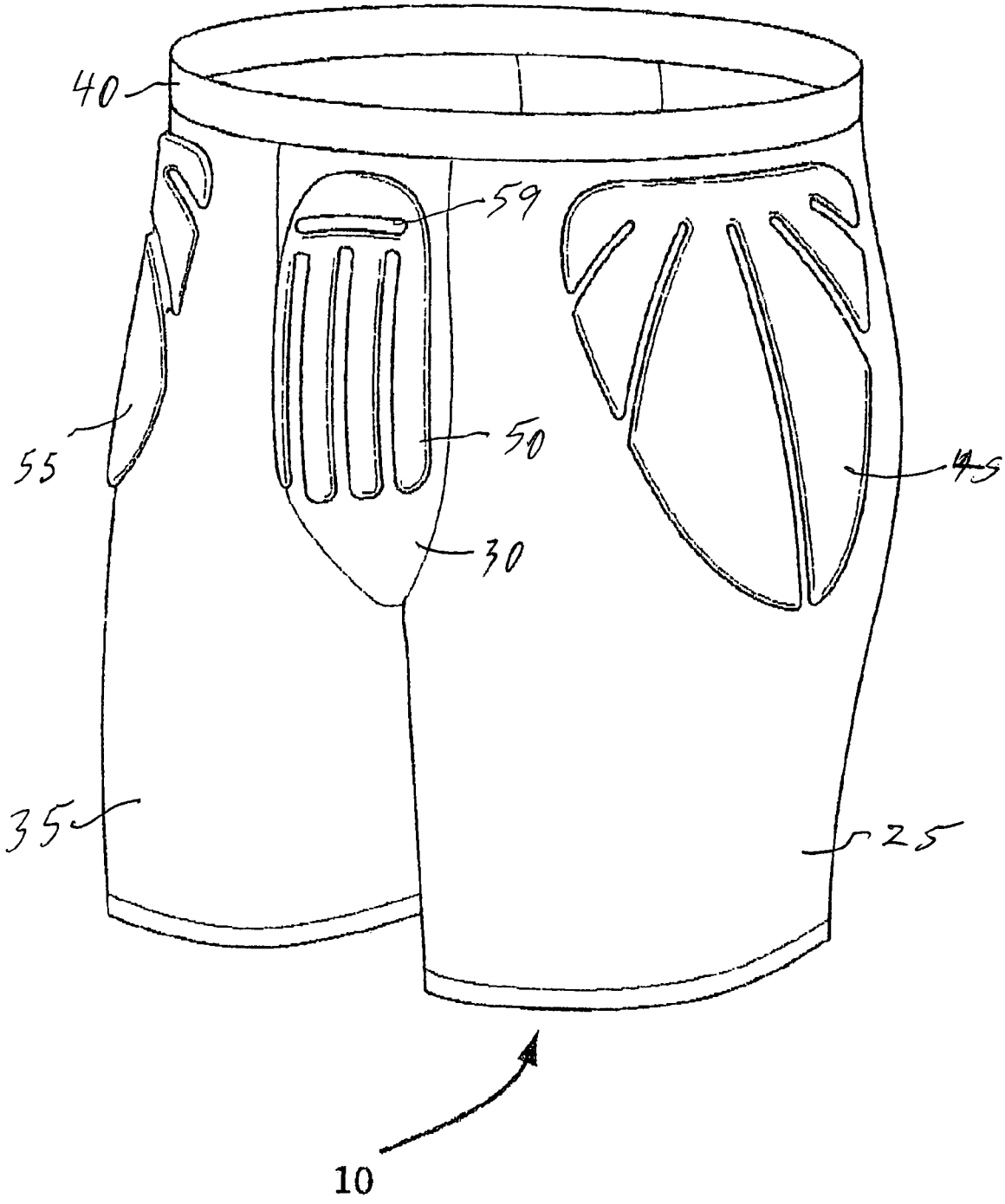
FIG. 1B is a rear perspective view of the protective undergarment of FIG. 1A.
Figure 3:
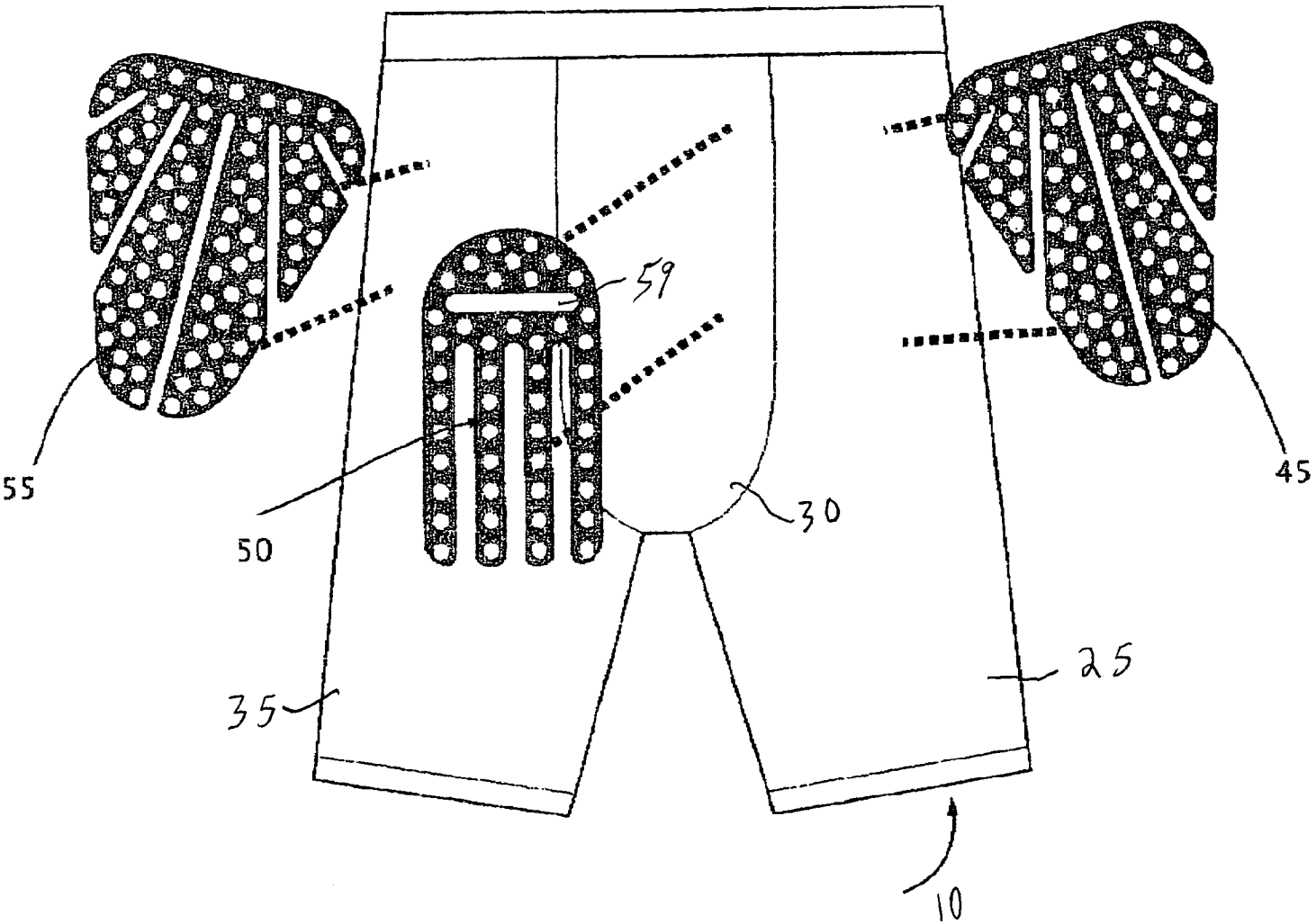
FIG. 3 is a partially exploded view of the protective undergarment of FIG. 1B, showing three protective pad segments and their relative permanent positions.

When a protective pad segment is small or is appropriately shaped, the welding may be limited to the perimeter of the pad segment. However, the larger the protective pad segment, the greater the risk that the pad segment will fold or relocate within its pocket. To control relocation, the pad segments 55 shown in FIG. 4 include a number of channels 57, while the polymeric film units 36 are die cut to have corresponding portions. As a result, the small-area fabric member 38 will be fused to the leg 35 within these channels. In FIG. 4, the channels all extend to the edge of the pad segment. This is not critical. As shown in FIGS. 1B and 3, the pad segment 50 that is connected to the center panel 30 includes a channel 59 that does not extend to the edge of the pad segment.

Figure 5:
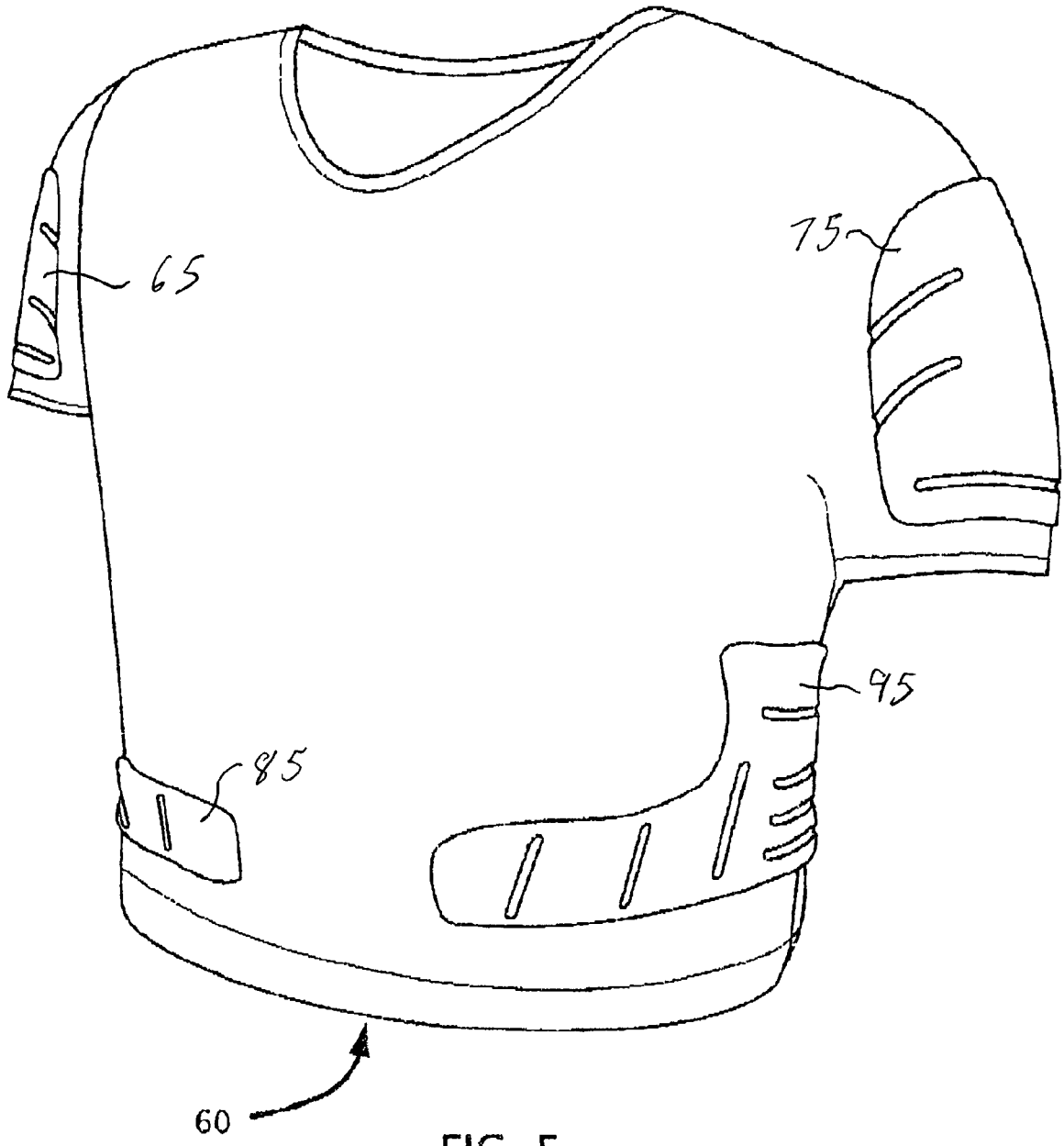
FIG. 5 is a front perspective view of a protective undergarment in accordance with the invention, wherein the undergarment has the shape of a shirt to be worn below other clothing.
Figure 6:
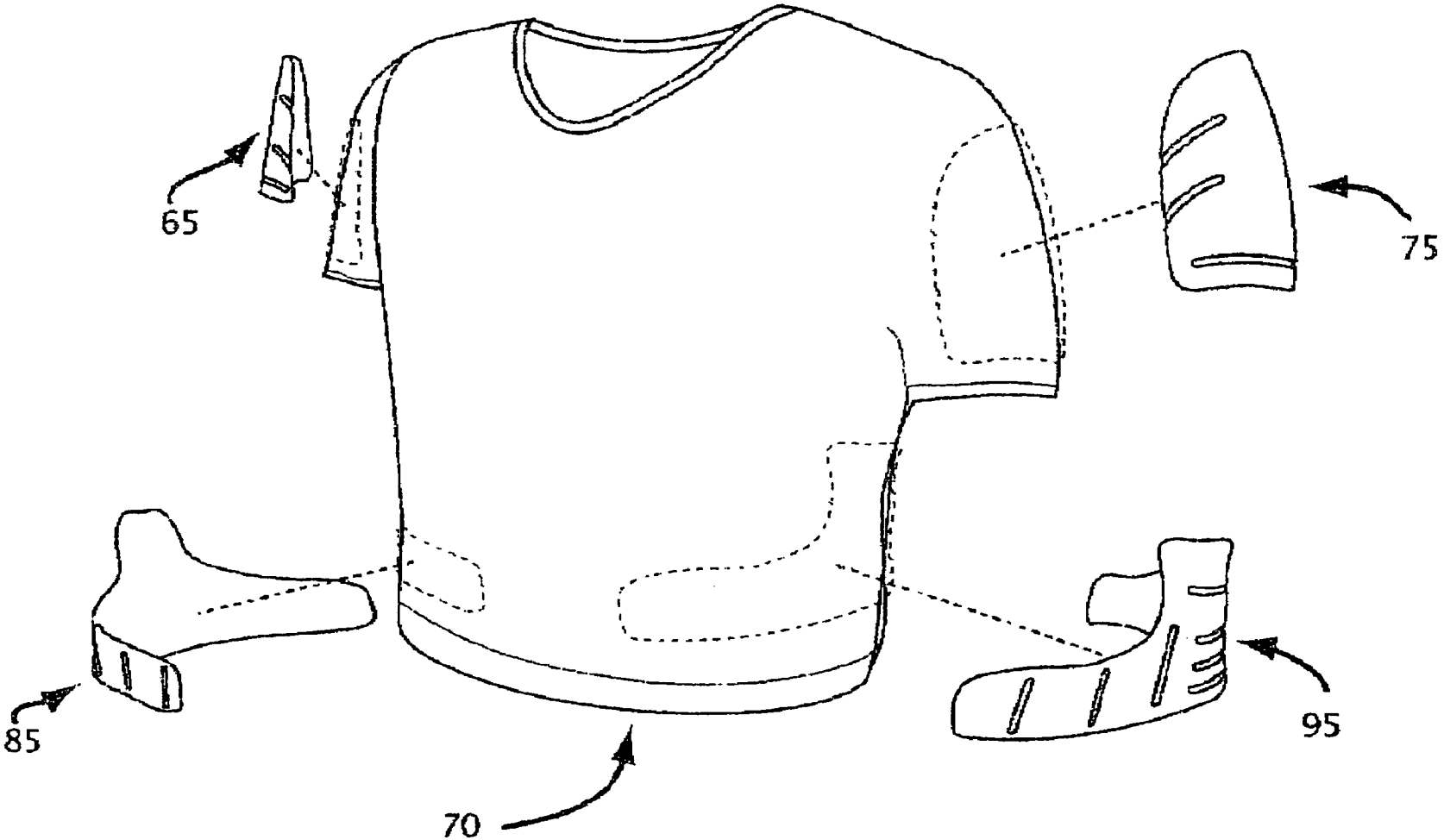
FIG. 6 is an exploded view of the protective undergarment of FIG. 5.

Referring now to FIGS. 5 and 6, in the second embodiment of a protective undergarment in accordance with the invention, the protective padded undergarment 60 is a shirt. The main body of material may be a single piece of fabric, or a number of attached fabric pieces. Each sleeve includes a protective pad segment 65 and 75. Two other pad segments 85 and 95 protect the sides of the wearer.

The four protective pad segments 65, 75, 85 and 95 are welded to the main body of material in the same manner that was described with reference to the trousers embodiment. Thus, ultrasonic welding may be used to permanently fuse the pad segments to the main body of the shirt. In FIGS. 5 and 6, each pad segment includes a number of channels that allow an associated small-area fabric member to be welded to the shirt material within the interior region of the pad segment. This ensures that the pad segments do not fold and do not move within the pockets that are formed when the small-area fabric members are welded to the main body of material that defines the shirt 60.

What is claimed is:

1. A protective undergarment comprising:

a main body of material configured for wear by a human, said main body of material including at least one piece of fabric which is air-permeable and moisture-wicking and which is able to simultaneously stretch in orthogonal directions;

a single-piece protective pad segment positioned adjacent to said main body of material and arranged to enable flexible motion of a wearer, said protective pad segment including at least one channel that extends into an interior region thereof, each said channel extending only partially across said interior region such that said protective pad segment remains as a single piece; and a fabric member threadlessly welded to said main body of material by an ultrasonic welding coupling, such that said protective pad segment is secured in position merely by entrapment between said fabric member and said main body of material, said ultrasonic welding coupling extending into said channel to restrict movement of said protective pad segment within said entrapment.

2. The protective undergarment of claim 1 wherein said fabric member and protective pad segment are secured to said main body of material with an absence of adhesive.

3. The protective undergarment of claim 1 further comprising a plurality of said protective pad segments and a corresponding number of said fabric members, each said fabric member being associated with one of said protective pad segments and being threadlessly welded to said main body of material to trap said associated protective pad segment in an absence of direct physical attachment of said protective pad segment to either said main body or said associated fabric member.

4. The protective undergarment of claim 3 wherein each said protective pad segment is a perforated closed-cell foam, thereby allowing cooling of the body of the wearer.

5. The protective undergarment of claim 3 wherein said fabric members and said main body of material are formed of fabric having moisture-wicking micro fibers.

6. The protective undergarment of claim 1 wherein said main body of material is configured as trousers.

7. The protective undergarment of claim 1 wherein said main body of material is configured as a shirt.

8. A method of forming a protective undergarment comprising:

utilizing at least one piece of air-permeable, moisture-wicking fabric to provide a main body of material in a shape of an undergarment, said fabric being capable of simultaneously stretching in orthogonal directions;

positioning a single-piece flexible protective pad segment adjacent to said main body of material in a location to provide protection for a wearer, including establishing a desired orientation of said protective pad segment relative to said main body of material such that at least one channel that extends only partially across an interior region has a position defined by said desired orientation; and threadlessly welding a fabric member to said main body of material such that said protective pad segment is entrapped in said location, including using ultrasonic welding techniques and including extending said welding into said at least one channel to secure said protective pad segment in said desired orientation without direct physical attachment of the protective pad segment to either said fabric member or said main body of material.

9. The method of claim 8 wherein positioning said protective pad segment and threadlessly welding said fabric member are steps which are executed to provide an adhesive-free assembly.

10. The method of claim 8 further comprising threadlessly welding a plurality of protective pad segments to said main body of material using a plurality of fabric members.

11. The method of claim 8 wherein threadlessly welding includes melting a polymeric film at areas of contact between said fabric member and said main body of material.

12. The method of claim 11 wherein said polymeric film has a melting temperature substantially equal to a softening temperature of said main body of material.

13. The method of claim 8 wherein said main body of material defines trousers.

14. The method of claim 8 wherein said main body of material defines a shirt.

* * * * *